US007731547B2

(12) United States Patent
Giefers

(10) Patent No.: US 7,731,547 B2
(45) Date of Patent: Jun. 8, 2010

(54) ELECTRICAL CONTACT DEVICE

(75) Inventor: Stefan Giefers, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 11/876,079

(22) Filed: Oct. 22, 2007

(65) Prior Publication Data

US 2008/0102712 A1 May 1, 2008

(30) Foreign Application Priority Data

Oct. 20, 2006 (DE) ..... 20 2006 016 424 U

(51) Int. Cl.
*H01R 13/502* (2006.01)

(52) U.S. Cl. ..... 439/701

(58) Field of Classification Search ..... 439/701, 439/79, 80, 947, 634, 839, 857, 686, 688
See application file for complete search history.

(56) References Cited

U.S. PATENT DOCUMENTS

| | | | | | |
|---|---|---|---|---|---|
| 4,274,701 | A | | 6/1981 | Bannert et al. | |
| 4,476,400 | A | * | 10/1984 | Jo et al. | 307/147 |
| 5,073,127 | A | * | 12/1991 | Daly et al. | 439/473 |
| 5,672,078 | A | * | 9/1997 | Fukamachi et al. | 439/701 |
| 5,980,325 | A | * | 11/1999 | Horchler | 439/660 |
| 6,089,925 | A | * | 7/2000 | Maltais et al. | 439/701 |
| 6,123,586 | A | * | 9/2000 | MacDougall | 439/701 |
| 6,146,202 | A | * | 11/2000 | Ramey et al. | 439/608 |
| 6,171,149 | B1 | * | 1/2001 | van Zanten | 439/608 |
| 6,196,853 | B1 | * | 3/2001 | Harting et al. | 439/79 |
| 6,293,827 | B1 | * | 9/2001 | Stokoe | 439/608 |
| 6,530,790 | B1 | * | 3/2003 | McNamara et al. | 439/108 |
| 6,623,310 | B1 | * | 9/2003 | Billman et al. | 439/701 |
| 6,648,696 | B2 | * | 11/2003 | Zemanik | 439/682 |
| 6,663,429 | B1 | * | 12/2003 | Korsunsky et al. | 439/608 |
| 6,749,468 | B2 | * | 6/2004 | Avery | 439/701 |
| 6,764,349 | B2 | * | 7/2004 | Provencher et al. | 439/701 |
| 6,884,117 | B2 | * | 4/2005 | Korsunsky et al. | 439/607 |
| 6,923,664 | B2 | * | 8/2005 | Ito et al. | 439/108 |
| 6,969,280 | B2 | * | 11/2005 | Chien et al. | 439/608 |
| 7,134,916 | B2 | * | 11/2006 | Wang | 439/660 |
| 2001/0012729 | A1 | * | 8/2001 | Van Woensel | 439/608 |
| 2002/0146941 | A1 | * | 10/2002 | Bradley | 439/701 |
| 2003/0017750 | A1 | * | 1/2003 | Morita et al. | 439/701 |

FOREIGN PATENT DOCUMENTS

DE 2713894 10/1978

* cited by examiner

*Primary Examiner*—T C Patel
*Assistant Examiner*—Vladimir Imas
(74) *Attorney, Agent, or Firm*—Leydig, Voit & Mayer, Ltd.

(57) ABSTRACT

An electrical contact device includes a housing having an insulating material and defining a first housing opening and a second housing opening, at least one shaft disposed in the housing, and a metal contact group disposed in the housing. The metal contact group includes a first contact connection assigned to the first housing opening and a second contact connection assigned to the second housing opening. The contact group has at least one attachment recess and the at least one shaft engages with the at least one attachment recess so as to secure the contact group.

9 Claims, 4 Drawing Sheets

ELECTRICAL CONTACT DEVICE

Priority is claimed to German Utility Model Application No. DE 20 2006 016 424.3, filed on Oct. 20, 2006, the entire disclosure of which is incorporated by reference herein.

The present invention relates to an electrical contact device with a housing made from insulating material, in which a metal contact group is attached to a first contact connection and a second contact connection connected to the latter by a connection piece, wherein the two contact connections are assigned housing openings for connecting contact elements.

BACKGROUND

Electrical contact devices, particularly terminal blocks, have been known in the art for decades and are used in their millions for the wiring of electrical systems and equipment. Terminal blocks are usually latched onto mounting rails, a multiplicity of which is usually disposed in turn in a switch cabinet. Known contact connections in electrical contact devices include screw-type terminals, tension spring terminals, cutting terminals or plug contact connections, particularly in the form of bushing or tulip contacts.

In addition, electrical contact devices are known in which at least a first contact connection is created by terminal legs for connection to a conductor plate and a second contact connection is formed as a plug connection for a plug connector.

Electrical contact devices should usually produce a current flow between two separate contact elements. In order to connect the contact elements, the electrical contact devices therefore have at least two contact connections, which are electrically connected to one another via a connection piece.

Apart from the aforementioned basic type of terminal blocks, there is also a multiplicity of different types of terminal block, which are specially adapted to suit each individual application. Given here by way of example are double-level or triple-level terminals and also three-conductor or four-conductor terminals, which then each have a correspondingly larger number of conductor connection elements designed as contact connections. In addition, there are terminal blocks consisting of a basic terminal and a connection plug, wherein the basic terminal has a terminal housing, at least one conductor connection element designed therein as a contact connection and also at least one other contact connection electrically connected to the conductor connection element and designed as a slot. The connection plug likewise has at least one conductor connection element and a plug contact electrically connected to the conductor connection element. With this type of terminal block, the basic terminal is usually first latched onto a mounting rail and the connection plug is then attached with its plug contact to a corresponding slot in the basic terminal.

All the aforementioned electrical contact devices, such as the terminal block, the electrical contact device for connecting to a circuit board, the basic terminal and the connection plug have a housing made from insulating material, in which a contact group with two contact connections is mounted and secured.

Rigorous requirements are made of the contact group's attachment within the housing, in order to prevent the contact group from becoming detached from the housing, leaving the user directly exposed to the live contact group. There is a particular risk of this happening when a contact element connected to one of the contact connections is forcibly removed. In order to secure the contact group within the housing, it is known from DE 27 13 894 A1, for example, that locking means can be provided on the contact group and inside the housing. This sort of attachment has already proved itself in practice. One perceived disadvantage of this sort of electrical contact device is that a reliable connection between the contact group and the housing only exists if it is actually locked to the housing. In order to guarantee this locking mechanism, the connection must be inspected following production of the contact device.

SUMMARY OF THE INVENTION

A problem addressed by the present invention is that of supplying an electrical contact device of the type mentioned above, which on the one hand creates a pull-resistant connection between the contact group and the housing and, on the other, makes an inspection of the connection following production of the terminal device unnecessary.

The present invention provides an electrical contact device of the type described above with a housing made from insulating material, in which a metal contact group is attached to a first contact connection and also a second contact connection attached to this by a connection piece, wherein the two contact connections are assigned housing openings for the connection of contact elements, in that the contact group has at least one attachment recess and at least one shaft designed to match the attachment recess is provided within the housing, said shaft engaging with the attachment recess when the contact group is fitted in the housing and securing the contact group. Due to the fact that during assembly the contact group is placed with its attachment recess on the housing shaft, a pull-resistant connection is provided as soon as the contact group is inserted. Apart from these advantages, the contact device according to the invention means that the contact group can only be released from the housing when pulled by destroying the shaft. Consequently, an extremely rigid connection is created between the contact group and the housing.

Furthermore, an advantage of the present invention is that the connection between the contact group and the housing can be detached non-destructively only when the housing is dismantled. This embodiment of the electrical contact device means that an accidental detachment of the contact group from the housing is immediately apparent to the user due to the fact that the housing is destroyed in the process.

BRIEF DESCRIPTION OF THE DRAWINGS

The electrical contact device in accordance with the invention is described below in an exemplary embodiment and depicted graphically. In the drawing.

and

Figure 1:
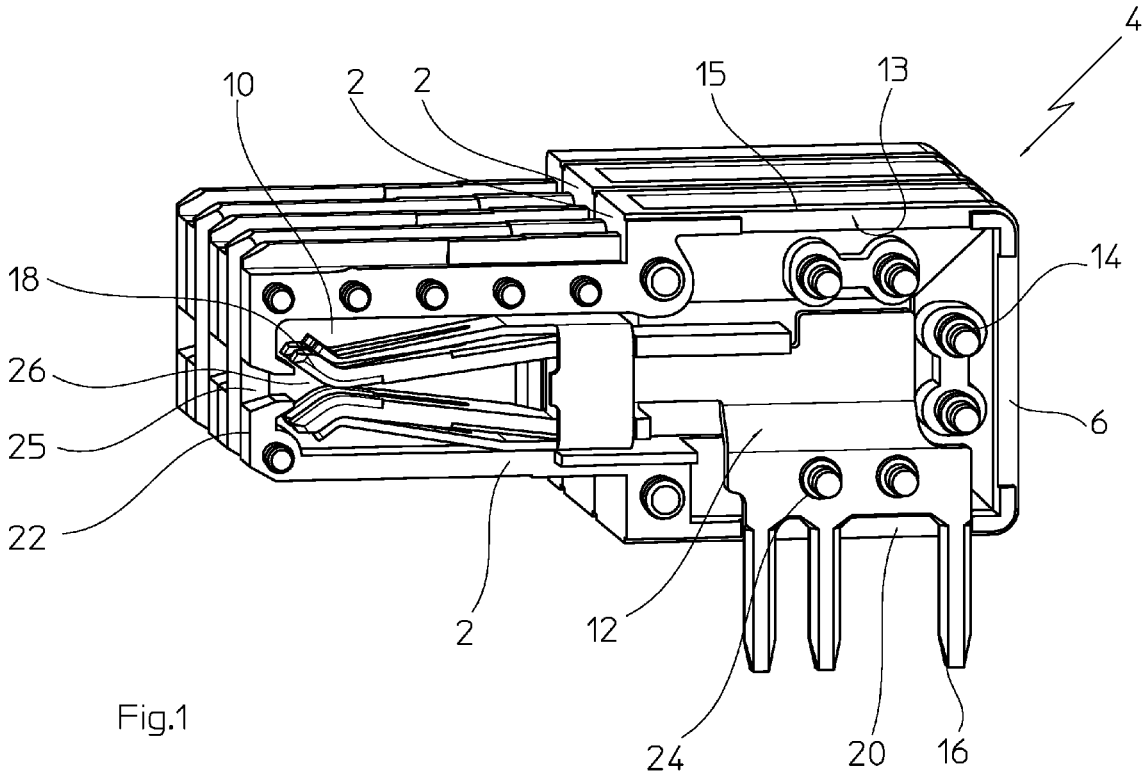
FIG. 1 shows a perspective view of the electrical contact device looking at the open housing and a first contact group inserted therein.
Figure 3:
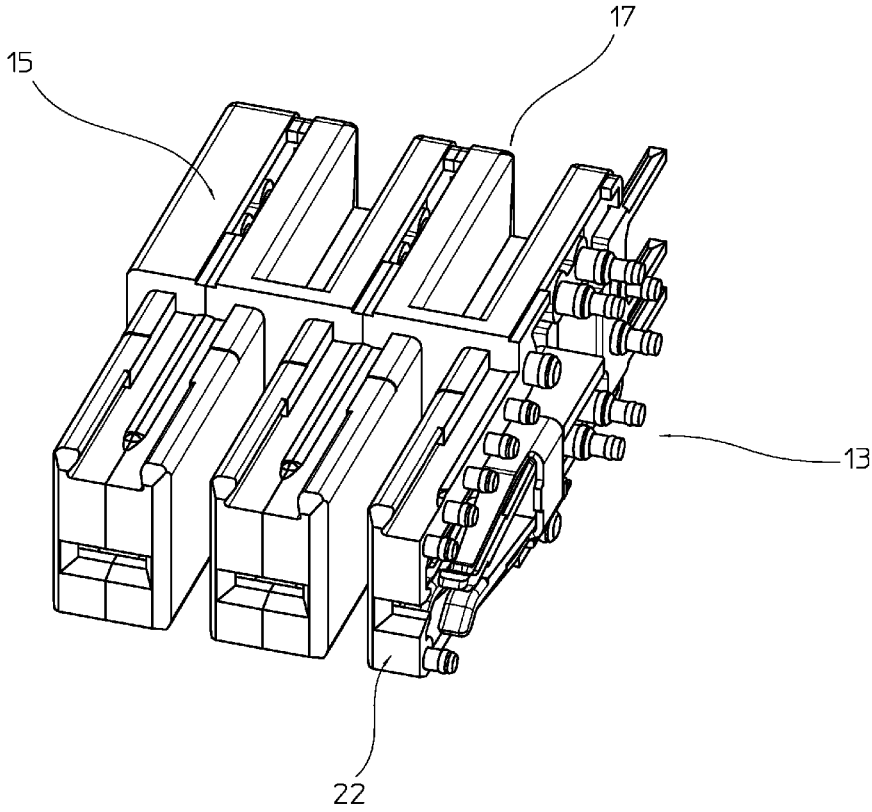
FIG. 3 shows a perspective view of the contact device in FIG. 2 looking at its upper side.
Figure 4:
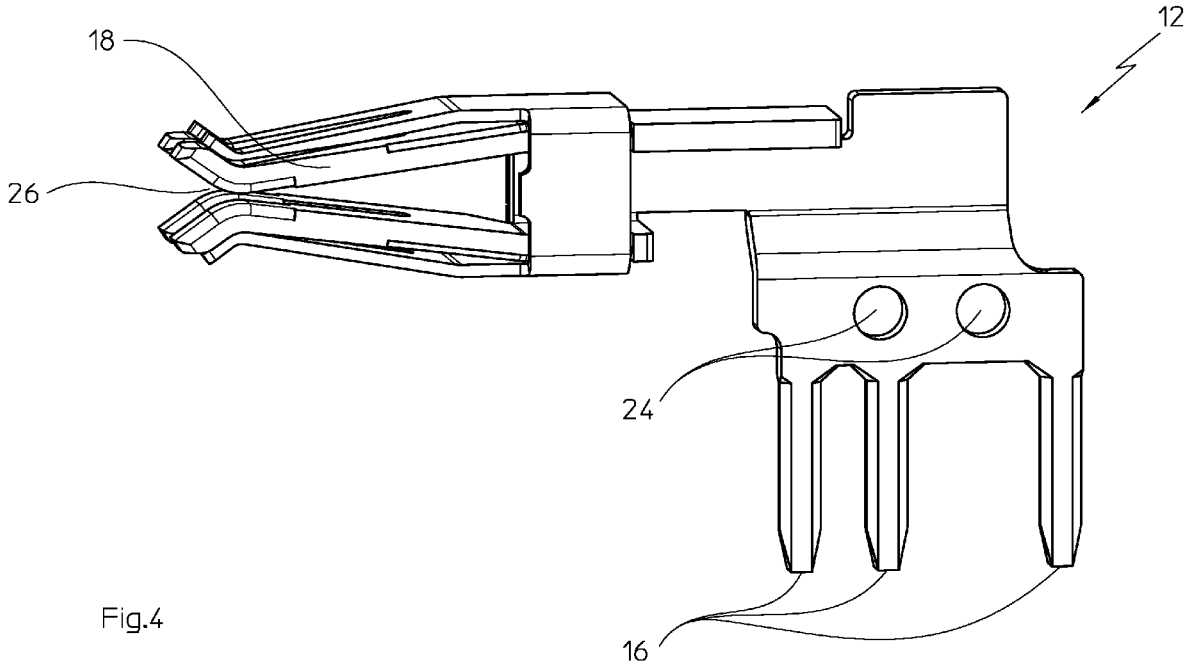

FIG. 4 shows the contact group removed from the housing in FIG. 1 and FIG. 3.

DETAILED DESCRIPTION

FIG. 1 shows a terminal configuration 4 created from identical electrical contact devices 2. Each of the individual contact devices 2 comprises a housing 6 with housing halves.

The inside of the housing 6 has a specially designed interior 10, which is open on one of the two longitudinal sides of the housing 6. The interior 10 houses a contact group 12 depicted individually in FIG. 4 and described in greater detail below.

Figure 2:
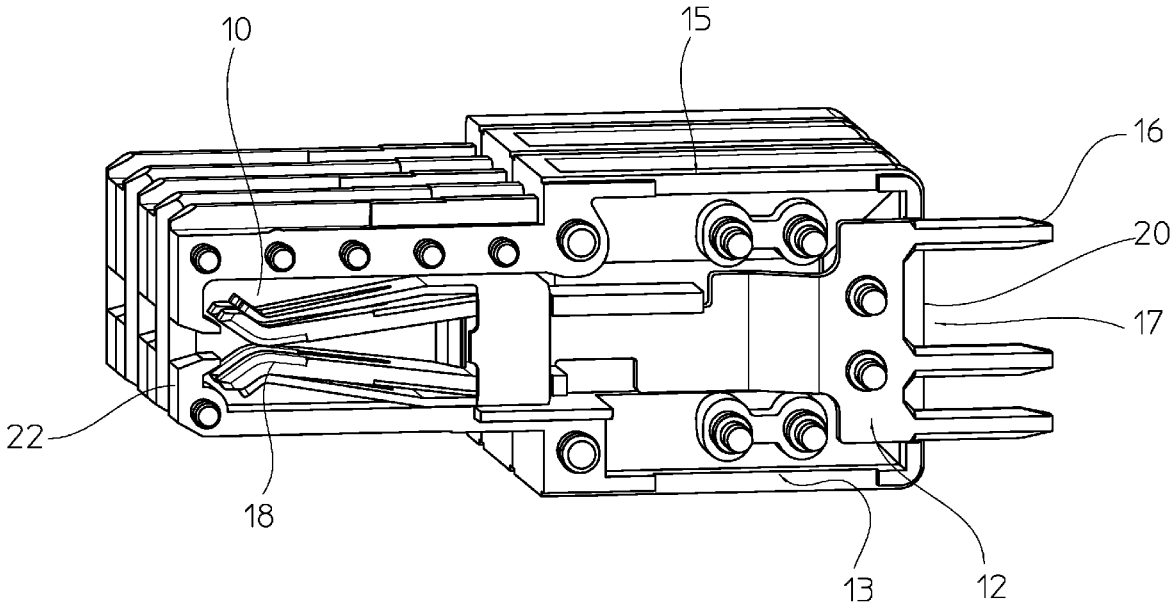
FIG. 2 shows a perspective view of the housing of the electrical contact device according to FIG. 1 looking at the open housing and a second contact group inserted therein.

At the elongated housing 6 made from insulating material with two longitudinal housing sides 13, two narrow housing sides 15 and two fronts 17, 22, at least one shaft 14 extending essentially perpendicularly to one of the two longitudinal housing sides 13 is disposed on at least one of the two housing halves. In accordance with the FIGS. 1 to 3 shown, several shafts 14 are disposed close to the edge of the interior 10. The shafts 14 are aligned with their longitudinal axes preferably mirror-symmetrically to a plane running parallel to one of the two narrow sides of the housing 15.

The housing 6 is closed on the second longitudinal housing side 13, which is not shown. On this longitudinal housing side assigned to the second housing half are located in a corresponding configuration blind hole-type recesses matching the shafts 14, to connect the two housing halves.

Two or more of the contact devices 2 are connectable to one another via the shafts 14 and the recesses and the terminal configuration 4 can thereby be created by stringing together the contact devices 2. In this way, the closed side wall of the housing 6 of each contact device 2 covers the interior 10 of the adjacent contact device 2.

For the contact device 2 disposed at one end of the row, on whose housing 6 the interior 10 is not covered and closed off by an adjacent contact device 2, a cover section is provided, which is not shown.

When the electrical contact device 2 is assembled, the shafts 14 engage with the attachment recesses 24 of the contact group 12 shown in greater detail in FIG. 4. The contact group 12 preferably takes the shape of an elongated metal part, wherein the attachment recesses 24 extend matching the shafts 14 with their longitudinal axes essentially perpendicular to the longitudinal side of the metal part or to the longitudinal side of the contact group 12.

Each contact device 2 itself comprises two contact connections 18, 16. They are part of the contact group 12 and serve to join at least two contact elements, to connect these together electrically. The contact connections 18, 16 and the attachment recesses 24 are aligned to one another in such a way that the connection direction of at least one contact connection runs perpendicular to the longitudinal axes of the attachment recesses 24.

In accordance with the designs shown in FIGS. 1 to 3, housing openings 20 for leading through the terminal legs 16 are provided on the first end of the contact device 2 on the longitudinal side as the first contact connection, preferably on at least one of the two narrow housing sides 15 and also on the front 17 of the first housing end. The contact device 2 can be connected to a circuit board not shown using THD (through-hole device) technology via the terminal legs 16 fed from the first housing openings 20.

As the second contact connection, at the opposite end of the contact device 2 a preferably tulip-shaped plug contact 18 is formed. Alternatively, however, it may also be provided that the second contact connection is designed as a terminal point for electrical conductors.

The tulip-shaped plug contact 18 houses a pin or sword-shaped contact element not shown here. The opening in the plug contact 18 designated 26 faces the front 22. The front 22 contains a further housing opening 25 aligned with the opening 26 of the plug contact 18, through which the pin or sword-shaped contact element not shown here can be guided into the plug contact 18.

What is claimed is:

1. An electrical contact device, comprising:

a housing including an insulating material and having a first housing opening and a second housing opening;

a plurality of shafts disposed in the housing; and a metal contact group disposed in the housing and including a first contact connection assigned to the first housing opening and a second contact connection assigned to the second housing opening, wherein the metal contact group has a plurality of attachment recesses disposed on a metal portion of the metal contact group, and each of the plurality of shafts is integral with the housing and engages with a respective one of the attachment recesses so as to secure the contact group.

2. The electrical contact device as recited in claim 1, wherein the housing is an elongated housing having two longitudinal housing sides, two narrow housing sides and two fronts, and wherein the shaft extends substantially perpendicularly to at least one of the two longitudinal housing sides.

3. The electrical contact device as recited in claim 1, wherein the contact group is shaped as an elongated metal part having a longitudinal side, the attachment recess extends matching the shaft substantially perpendicular to the longitudinal side of the contact group.

4. The electrical contact device as recited in claim 1, wherein the attachment recess is aligned substantially perpendicular to a connection direction of at least one of the first contact connection and the second contact connection.

5. The electrical contact device as recited in claim 1, wherein the plurality of shafts and the housing are formed as a single piece.

6. The electrical contact device as recited in claim 1, wherein the housing is an elongated housing having two longitudinal housing sides, two narrow housing sides and two fronts, wherein the first contact connection includes terminal legs configured for connection to a conductor plate, wherein the first housing opening for leading through the terminal legs is provided on a first housing end on at least one of the two narrow housing sides and also on a front of the first housing end.

7. The electrical contact device as recited in claim 1, wherein the housing includes two housing halves connectable via the shaft.

8. The electrical contact device as recited in claim 7, wherein the housing is an elongated housing having two longitudinal housing sides, two narrow housing sides and two fronts, and wherein the plurality of shafts is disposed in at least one of the two housing halves, the plurality of shafts being aligned mirror-symmetrically to a plane running parallel to one of the two narrow sides of the housing.

9. The electrical contact device as recited in claim 1, wherein the second contact connection is one of a plug contact and a terminal point for electrical conductors.

* * * * *